US009199258B2

(12) United States Patent
Pritchett et al.

(10) Patent No.: US 9,199,258 B2
(45) Date of Patent: Dec. 1, 2015

(54) PUMP DISPENSERS

(71) Applicant: Rieke Corporation, Auburn, IN (US)

(72) Inventors: David John Pritchett, Ashby de la Zouch (GB); Simon Christopher Knight, Brigend (GB); Joseph Stanley Brunton, Fordham (GB)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 14/585,446

(22) Filed: Dec. 30, 2014

(65) Prior Publication Data

US 2015/0122847 A1 May 7, 2015

Related U.S. Application Data

(63) Continuation of application No. PCT/GB2013/051775, filed on Jul. 4, 2013.

(30) Foreign Application Priority Data

Jul. 5, 2012 (GB) ..... 1212042.4

(51) Int. Cl.
*B67D 7/58* (2010.01)
*B05B 11/00* (2006.01)

(52) U.S. Cl.
CPC ..... *B05B 11/3015* (2013.01); *B05B 11/0005* (2013.01); *B05B 11/0048* (2013.01); *B05B 11/3061* (2013.01); *B05B 11/3074* (2013.01); *B05B 11/0072* (2013.01);
(Continued)

(58) Field of Classification Search
CPC ..... B05B 11/3015; B05B 11/0005; B05B 11/0048; B05B 11/3061; B05B 11/3074; B05B 11/0072; B05B 11/0097; B05B 11/3047; B05B 11/3069
USPC ..... 222/383.1, 256, 257, 386, 387
See application file for complete search history.

(56) References Cited

U.S. PATENT DOCUMENTS 1,283,050 A 10/1918 Berg
2,469,746 A 5/1949 Sanchis
(Continued)

FOREIGN PATENT DOCUMENTS

EP 0 098 939 A2 1/1984
EP 0 274 256 A1 7/1988
(Continued)

OTHER PUBLICATIONS

PCT/GB2011/001001 Search Report and Written Opinion dated Nov. 24, 2011.
(Continued)

*Primary Examiner* — J. Casimer Jacyna
*Assistant Examiner* — Benjamin R Shaw
(74) *Attorney, Agent, or Firm* — Woodard Emhardt Moriarty McNett & Henry LLP; James Durlacher

(57) ABSTRACT

A pump dispenser includes a container whose top opening is closed off by a base structure of a pump module. The structure is shaped to guide air to an air pocket region adjacent the wall. This air pocket region communicates with the pump inlet opening so that air can be discharged. The pump may include a pump body and a plunger which incorporate respective different ones of a click projection and a click actuating formation, constituting a click indicator.

15 Claims, 4 Drawing Sheets

(52) U.S. Cl.
CPC ..... *B05B 11/0075* (2013.01); *B05B 11/0097* (2013.01); *B05B 11/3047* (2013.01); *B05B 11/3069* (2013.01)

(56) References Cited

U.S. PATENT DOCUMENTS

| | | | | |
|---|---|---|---|---|
| 2,919,056 | A | 12/1959 | Collins | |
| 4,343,417 | A | 8/1982 | Corsette | |
| 4,376,495 | A | 3/1983 | Spatz | |
| 4,496,082 | A | 1/1985 | Corsette | |
| 4,511,065 | A | 4/1985 | Corsette | |
| 4,515,298 | A | 5/1985 | Czech | |
| 4,771,925 | A * | 9/1988 | Stoffler et al. | 222/207 |
| 4,790,442 | A | 12/1988 | Gach | |
| 4,811,871 | A | 3/1989 | Wass et al. | |
| 4,856,679 | A | 8/1989 | Czech | |
| 4,872,596 | A | 10/1989 | Corsette | |
| 4,890,773 | A * | 1/1990 | Corsette | 222/380 |
| 5,096,094 | A | 3/1992 | Guilbert | |
| 5,115,980 | A | 5/1992 | SKorka | |
| 5,462,204 | A | 10/1995 | Finn | |
| 5,878,916 | A | 3/1999 | DeJonge | |
| 5,878,922 | A * | 3/1999 | Boring | 222/387 |
| 5,904,272 | A | 5/1999 | Kaufman et al. | |
| 6,053,368 | A | 4/2000 | Geimer | |
| 6,062,433 | A | 5/2000 | Fuchs | |
| 6,179,164 | B1 | 1/2001 | Fuchs | |
| 6,240,979 | B1 | 6/2001 | Lorscheidt | |
| 6,257,454 | B1 | 7/2001 | Ritsche | |
| 7,044,339 | B1 | 5/2006 | Kuo | |
| 7,798,348 | B2 | 9/2010 | Sawyer | |
| 8,118,193 | B2 | 2/2012 | Law | |
| 8,556,130 | B2 | 10/2013 | Law et al. | |
| 2002/0148860 | A1 | 10/2002 | Cohen et al. | |
| 2003/0132252 | A1 | 7/2003 | Rossignol | |
| 2004/0129733 | A1 | 7/2004 | Schultz | |
| 2005/0035153 | A1 | 2/2005 | Brown | |
| 2005/0133475 | A1 | 6/2005 | Goto et al. | |
| 2005/0205607 | A1 | 9/2005 | Hierzer et al. | |
| 2006/0043117 | A1 | 3/2006 | Law et al. | |
| 2007/0200010 | A1 | 8/2007 | Girerd | |
| 2008/0083782 | A1 | 4/2008 | Heusser et al. | |
| 2008/0197149 | A1 | 8/2008 | Law et al. | |
| 2008/0308183 | A1 | 12/2008 | Law | |
| 2009/0065531 | A1 * | 3/2009 | Decottignies | 222/207 |
| 2009/0212074 | A1 | 8/2009 | Brouwer | |
| 2009/0218008 | A1 | 9/2009 | Law | |
| 2010/0276515 | A1 | 11/2010 | Milanese | |
| 2012/0097714 | A1 | 4/2012 | Hoefte et al. | |
| 2012/0261418 | A1 | 10/2012 | Cronin et al. | |
| 2013/0008924 | A1 * | 1/2013 | Lafosse | 222/256 |
| 2013/0200106 | A1 | 8/2013 | Kang | |
| 2014/0312072 | A1 | 10/2014 | Knight et al. | |

FOREIGN PATENT DOCUMENTS

| | | | |
|---|---|---|---|
| EP | 0 327 421 | A1 | 8/1989 |
| EP | 0 509 863 | A1 | 10/1992 |
| EP | 1 092 447 | A2 | 4/2001 |
| EP | 1 015 341 | B1 | 1/2004 |
| EP | 1 449 595 | A1 | 8/2004 |
| EP | 1 629 900 | A2 | 3/2006 |
| EP | 2 095 882 | A1 | 9/2009 |
| EP | 2 133 153 | A1 | 12/2009 |
| EP | 2 153 908 | A1 | 2/2010 |
| EP | 2 353 727 | | 8/2011 |
| GB | 2360273 | A | 9/2001 |
| WO | WO 03/101620 | A1 | 12/2003 |
| WO | WO 2005/049477 | A2 | 6/2005 |
| WO | WO 2010/023462 | A1 | 4/2010 |
| WO | WO 2012/001375 | A1 | 1/2012 |

OTHER PUBLICATIONS

PCT/GB2011/001002 Search Report and Written Opinion dated Sep. 26, 2011.

PCT/IB2013/050101 International Preliminary Report on Patentability dated Jul. 8, 2014.

U.S. Appl. No. 12/685,064 to David John Pritchett, Office Action mailed Aug. 17, 2012.

* cited by examiner

PUMP DISPENSERS

CROSS-REFERENCE TO RELATED APPLICATION

This application is a continuation of International Application No. PCT/GB2013/051775 filed Jul. 4, 2013, which claims the benefit of United Kingdom Patent Application Serial No. 1212042.4 filed Jul. 5, 2012.

TECHNICAL FIELD

This invention is about pump dispensers.

BACKGROUND

Pump dispensers having a pump mounted on a container of product are widely used for dispensing fluid products (liquids, creams, pastes) such as medicaments, bathroom products and cosmetics.

Usually the pump body comprises a cylinder as a fixed component. A piston may be on the inner end of the plunger, whose outer manually-engageable end projects from an opening in the body, and which is reciprocable in a pumping stroke to alter the volume of the pump chamber. Therefore, dispenser pumps are typically of a kind in which the pump chamber is defined between a piston and a cylinder. Liquid product enters the pump chamber through a valved inlet and leaves it through an outlet—usually also valved—leading along an outlet channel to a discharge opening. Commonly used valves include ball and flap valves.

Conventionally the plunger projects upwardly from the top of the pump body and the pump chamber inlet is at the bottom of the pump body, drawing product by suction from the container interior beneath. So, for convenience herein the expressions "top", "upper" etc. are used to refer to positions and directions towards the extended direction of the plunger, and "bottom", "downwards" etc are used analogously to refer to the opposite direction/position, although this particular orientation is not essential. The dispenser is preferably of a hand-held type, used generally upright.

Usually the pump body comprises a generally cylindrical portion constituting the cylinder in which the piston works. The pump components are typically of moulded plastics materials. A pump spring is usually provided to urge the plunger towards an extended position. Many hand-operated dispensers are of the "movable nozzle" type in which the outlet, outlet channel and discharge opening are in the plunger component. Others are of the "fixed nozzle" type in which the outlet from the pump chamber, like the inlet, is part of the pump body so that the discharge channel and discharge opening need not move when the plunger is operated. The present proposals are applicable to pump dispensers of both kinds, but fixed nozzle is preferred.

The present proposals are especially relevant for dispensers of the "airless" type, in which the internal product chamber volume of the container which supplies the pump reduces as product is dispensed, so that remaining product is not exposed to air. Such dispensers may use collapsible containers, collapsible container liners or containers with a follower piston which moves up the container behind the mass of product as its volume progressively decreases. They are used when the fluid product is sensitive to oxidation or to airborne contamination.

Measures are usually taken to avoid trapping air in the container when an airless dispenser is filled and assembled.

In some cases the pump structure and assembly process provide for air to escape through the pump itself, e.g. through the dispensing path or through a vent structure, as the pump module is fixed in place onto the filled container. For example EP-A-1015341 (U.S. Pat. No. 6,240,979) has a pump with a wide tubular chimney extending down around the pump inlet. The container is filled sufficiently that, when the pump module is pushed down into place, product is displaced upwardly to fill the pump chamber. Other dispensers providing for venting of residual air are seen in EP2153908A and EP2095882A, also our EP2353727. In these, air reaches an enclosed trap or collecting space in the upper part of the structure to prevent its getting back into the container space. Another known approach shapes the bottom of the pump module to promote escape of air through the annular gap between the container neck edge and the pump body as they are pushed together. See e.g. our EP-A-1629900 in which the bottom of the pump module (with a central inlet opening for the pump chamber) forms a deep central floor with a steeply upwardly-inclined peripheral wall leading up to snap formations which lock into the container neck. The bottom of the pump module dips into the product as the pump module is pushed in, displacing air through the narrow peripheral clearance as they move towards engagement.

We have noted that the effectiveness of different structures and procedures for eliminating trapped air varies with the viscosity of the product. With viscous products, there is less flow and slower movement of bubbles. A positive displacement action (e.g. dipping of the pump module) then helps to expel air, but this happens only on assembly. Conversely, in designs which trap or sequester air within the dispenser to keep it away from the pump inlet, there is a risk with lower viscosity fluids that air finds its way back into the container interior.

One aspect of our present proposals is to provide pump dispensers adapted to eliminate or avoid air trapping, especially when relatively fluid (lower viscosity) products are packaged. A particular context for the proposals is in dosing dispensers, such as for the direct oral administration of products such as medicines, e.g. medicines for children. In this context accurate dosing and confidence in accurate dosing are of high importance.

Typically pump modules comprise the pump itself (body and plunger, usually defining a piston and cylinder between them) and an outwardly-extending adapter component which is shaped and dimensioned to fit and fix into or onto the container opening to mount the pump in place and close the container top. The adapter may be integral with the pump module, or discrete but fixed to it e.g. by snap fit. The pump module is pushed into the container opening after the container has been filled. If the product is over-filled (and some variation is inevitable in practice) there is a risk of product being squeezed right out through the gap; this must be avoided. A known measure is to start the filling with the follower piston slightly displaced upwards, so that it can move down to accommodate any excess.

Technical Problems

Difficulties are still encountered with trapped air. This is important when accurate dosing is required, e.g. for medicaments. With a fresh dispenser, usually nothing is dispensed until the pump chamber is fully primed and the user knows when a full dose is achieved. However if air is trapped at some position initially remote from the inlet but reaches it later, especially when the container is nearly empty, incomplete doses may be dispensed without the user knowing. Or, remaining product is discarded and wasted because an accurate dose can no longer be assured.

SUMMARY

First Aspect

A first aspect of our proposals relates to dispensers of the airless type.

In this proposal the pump module has a downwardly-directed base structure that includes a downwardly-directed central displacement base portion and a peripheral air pocket region which is adjacent the container wall in the assembled dispenser. As in previous proposals, this air pocket region may be defined by a generally laterally or radially-directed wall portion of the base structure, e.g. a wall portion inclined at at least 45° to a vertical axis. It may extend around all or only part of the periphery of the pump module base structure. It may be e.g. a substantially conical or downwardly-tapering surface portion around all or part of the periphery of the base structure. The central displacement face may be flat or downwardly convex; preferably it is free of downward concavity. Desirably this inclined pump base surface faces directly onto the container wall. Also, in the assembled container, it preferably converges with the container wall towards a joint-forming portion of the pump module having a radially-outwardly directed joint formation such as one or more snap ribs or grooves which engage an inwardly-directed joint portion of the container.

As described thus far the pump module base structure may be similar to that seen in our above-mentioned EP1629900. The product level is adjusted on filling so that when the pump module is pushed into place the displacement base dips into the product and air is pushed out between the pump module and the container rim as they move together.

Our new proposal is that a pump inlet opening, being defined by inlet structure of the pump leading to the pump chamber thereof, opens into the air pocket region. Thus, trapped air accumulating in the air pocket region—which will in practice be the highest point in the filled container—will be forced or drawn out of the container space and into the pump (either during assembly or on initial priming of the pump in use) before product is dispensed.

Compared with prior proposals which trap or sequester air away from the inlet, this has the advantage that trapped air is positively eliminated in early priming of the pump even if it reaches the top after assembly.

Typically the inlet structure comprises an inlet conduit or inlet passage leading from the inlet opening to a pump chamber entrance having a unidirectional inlet valve. This pump chamber entrance is usually positioned away from the pump module periphery, e.g. at or near the axial centre of the pump module (e.g. in line with a pump plunger operating axis). Thus, the preferred inlet conduit in our proposal will extend at least partly in a radial direction between the inlet opening and the pump chamber entrance.

Preferably the inlet opening is circumferentially localised so as to draw product (and any initial air purge) from a particular position on the periphery of the pump module base. Thus, the inlet conduit may be generally tubular. It may be substantially horizontal, or include a substantially horizontal portion (e.g. within 20° or 30° of horizontal as it extends from the inlet opening. This provides vertical compactness, since the pump chamber entrance is often at the bottom of the pump chamber. Generally the inlet opening is laterally (e.g. radially) directed, and may open through the mentioned inclined or convergent peripheral base surface, i.e. opening into the air pocket region opposed to the container wall.

Desirably the inlet opening subtends less than 10% and preferably less than 5% of the peripheral length of the pump module base structure. Desirably there is a only a single inlet opening.

The positioning of a localised inlet opening can be valuable in optimising or adjusting its effect. In particular the dispenser may have a laterally-directed dispensing nozzle, e.g. directed radially and upwardly (suitable for an oral administration dispenser). This typically leads to tilting of the container in use, with the region opposite the nozzle being raised as the user brings the nozzle towards the horizontal. Preferably the air pocket region is present at least at the position opposite such a nozzle is therefore preferred although as mentioned the air pocket region may extend all around the pump periphery to maximise the collection of any residual air. With this in mind the inlet opening may be directed rearward, i.e. be on the side opposite to the direction of the nozzle, so that on initial use (usually the first priming of the pump chamber, which is not normally expected to produce an immediate complete dose) any trapped air will be eliminated immediately through the inlet opening at this stage without causing any additional inaccurate doses.

Depending on the intended use and the overall design of the dispenser, e.g. the disposition of any spout and the likely orientation in use, the inlet opening may be differently positioned. For example in an alternative the inlet opening may be positioned forwardly, i.e. on the same side as a laterally-projecting spout. Such a disposition may reflect an alternative precautionary approach, i.e. that if despite all precautions further air has accumulated during the lifetime of the dispenser, and the dispenser is tilted during use, then positioning the inlet opening for fluid on the downward side, i.e. away from the possible position of any such accumulated air, is a way of keeping such air out of the dispensed dose. Of course in other respects such an inlet opening operates in the same way as described above during assembly and first priming to help eliminate air at that stage.

Structurally, the pump module base formations described above (central displacement region, peripheral inclined region, inlet opening) are desirably formed in a single component. As mentioned this component desirably has a peripheral portion fitting sealingly around the wall of the container. While in principle this fitting part might also be the securing formation which holds the pump module in place (e.g. by screw thread or snap ribs), in practice it may be difficult to form a transversely-extending inlet conduit in such a component which would usually also have axially-directed formations for mounting the pump chamber and so forth.

Desirably therefore the downwardly-directed pump module base structure having the above-mentioned formations is provided as a discrete element attached beneath an internal floor of the pump module, e.g. a flat floor, which may have an opening for the pump entrance. An inlet valve for the pump entrance may be supported on or in this floor at the opening. The floor may include a connector structure such as a socket or spigot at the pump chamber entrance opening for connecting to an inlet conduit formed in the discrete base element. This structure, (e.g. a vertical fitting tube) may also be a means of holding the base element onto the pump module. A laterally (e.g. radially) extending tubular inlet conduit may be integrally formed with this discrete base element.

One preferred version of the present proposals is a fixed-nozzle dispenser with the pump operation axis (plunger axis) positioned off-centre relative to the circular plan of the pump module. A riser portion of a discharge passage of the dispenser may be positioned laterally adjacent the pump chamber, leading to a discharge nozzle which is beside the pump plunger.

The above features may be used in conjunction with a dispenser of the kind in our WO2012/001375, the whole contents of which are hereby incorporated by reference, that is to say, a dispenser having a discharge outlet, operable to dispense a fluid product from a supply container in doses from the discharge outlet, and wherein the discharge outlet has an outlet closure valve with a closure mechanism comprising a closure member which in a closed position closes the discharge outlet, and having a separate outlet attachment defining an outlet conduit having a nozzle opening, and which can be coupled to the dispenser at the discharge outlet by a coupling structure, the outlet attachment further comprising an actuating structure which in a coupled condition, with the outlet attachment coupled to the dispenser at the discharge outlet, engages the closure mechanism of the dispenser's said outlet closure valve to hold the closure valve in an open condition, putting the dispenser discharge outlet in fluid communication with the outlet conduit and nozzle opening of the outlet attachment so that fluid product can be dispensed from the dispenser through the outlet attachment.

Second Aspect

A second and independent aspect of these proposals is about signalling the completion of a dispensing stroke to a user, in a dispenser having a pump plunger operable relative to a pump body with a pump chamber defined between them. It has previously been proposed to provide a 'click' indicator whereby click formations on the respective relatively movable parts, when brought into register (in the axial direction) at the end of the stroke, suddenly coming into engagement with relaxation of a resilient force giving a 'click' signal which is audible (or sensible by touch) for the user.

Our proposal is for a pump having a pump plunger which moves relative to a pump body in a dispensing stroke. The plunger has an outer part (usually top part) which is outside a pump chamber of the pump. This outer part may comprise a plunger stem and a push-button component, sometimes a separate component, on top of the stem. Preferably—and particularly in a fixed-nozzle type of pump which is desirable here—the body defines an upstanding surround wall, defining a recess into which the pump plunger descends.

To provide a click signal, one of the body and plunger carries a click projection and the other has a click actuating formation which meets a tip of the click projection as the plunger approaches the bottom of its stroke. The click projection is elongate and resiliently flexible, preferably only by its own elasticity rather than by an added spring element. The click actuating formation bends the click projection against its resilience as the plunger approaches the completion of its stroke (stroke endpoint). For example the click actuating formation may be axially spaced from the click projection in the starting position of the plunger, and has a deflecting or pusher part which engages the click projection at a predetermined spacing before the endpoint and starts to bend it. At the stroke endpoint the click projection escapes the actuating portion, generally by retraction associated with bending away from the original projecting direction. Then the click projection is suddenly released and resiliently returned to its original orientation. The click actuating structure has a clearance (preferably provided as a recess on the other side of a point structure) to allow this sudden resilient return and a counter-surface which is struck by the tip of the click projection. Striking the counter-surface emits a click signal which is much more audible than the click associated with the projection tip merely escaping from the click actuating structure on release.

To provide an elongate structure of the click projection, enabling substantial flexing resistance and corresponding force of striking the counter-surface, desirably the point from which the click projection is projected (i.e. as a cantilever) and the position of the click actuator are desirably spaced substantially apart, preferably spaced circumferentially in relation to the axis of the pump plunger, and at a radial spacing from that axis.

The respective click structure of the plunger may project down beneath a push-button on top of the plunger, or be provided as a formation on the outside of a stem thereof. The respective click structure on the pump body may be comprised integrally with a pump cylinder-forming component. Desirably the click structures are enclosed within a body surround recess as mentioned above, to protect them.

Preferably the click projection is an elongate pointed flexible finger, which may extend generally circumferentially or tangentially. It may be fixed to or formed integrally with the pump body. Desirably the click actuating portion is a dependent or projecting structure beneath the top of the plunger. It may include an end pushing face, a projecting point at the side of the pushing face, a recessed side surface past the point and a counter-surface, preferably flat, beyond the recessed side surface. The point (e.g. a step or tooth form) is the last part engaged by the tip of the click finger and defines the position at which it escapes and springs back.

It will be understood that corresponding formations could be provided either way up, i.e. respectively on the other of the body and the plunger.

BRIEF DESCRIPTION OF DRAWINGS

Embodiments of the proposals are now described by way of example, with reference to the accompanying drawings in which.

DESCRIPTION OF THE SELECTED EMBODIMENTS

Figure 2:
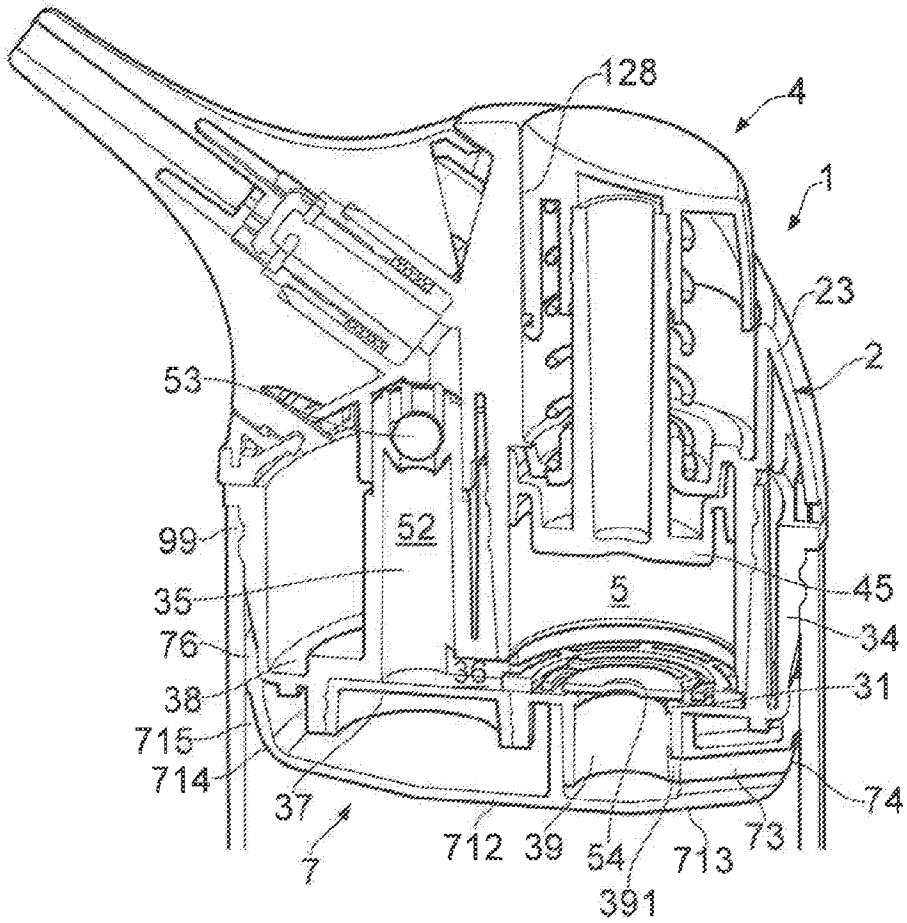
FIG. 2 is an enlarged view of the pump portion.
Figure 1:
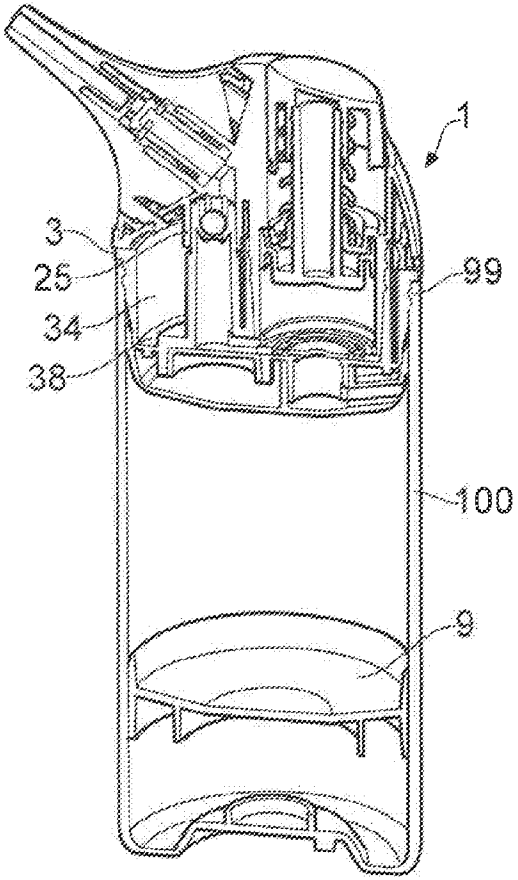
FIG. 1 is an axial cross-section of a first embodiment of fixed-nozzle dispenser for oral dosing in perspective.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Modes of Carrying Out the Invention

Referring to FIGS. 1 to 4, a fixed-nozzle dispenser for dosing medicine to children comprises a product container 100 with snap ribs 99 around its top opening into which a pump unit 1 is fitted. A sealed follower piston 9 is provided in the container 100 and rises as product is dispensed. The dispenser pump module has a body mounting element 3 or adaptor which plugs down into the container opening. The mounting element or adaptor 3 is generally bowl-shaped, with an outer surround wall 34 which plugs into the container neck and a floor 38 with an eccentric inlet opening 31 controlled by an inlet valve 54. At a rear position, above the inlet opening 31, the mounting element 3 has an upwardly-extending socket 32 for a pump cylinder. At a front position an upward outlet tube 35 projects up from the floor 38 and houses an outlet ball valve 53.

A horizontal outlet channel 36 connects the vertical outlet passage 52 in the tube 35 with the pump chamber space 5 to the rear, and is closed off from beneath by a snapped-in closure plate 37.

A top body element or body shell 2 fits down onto the body mounting element 3 to complete the pump flow system. The top body element 2 includes at the rear a pump cylinder 24 which plugs down into the cylinder socket 32 to define the pump chamber 5. At the front it has a downwardly-projecting socket 25 which connects down to the outlet tube 35 and leads up to a discharge outlet structure described in more detail below. The top body element 2 also has a surround shell 23 which fits down onto an upward collar of the mounting element 3 to enclose the flow control components. At the back of the pump this shell has a guide recess 128 in which a plunger button 49 of a pump plunger 4 is operable. This plunger button is on the top end of a piston stem 41 carrying a piston 45 at its bottom end. The piston 45 operates in the cylinder 24, the top wall of which projects inwardly connecting to an integrally-formed tubular stem guide 22. A return spring 46 between the button 49 and cylinder 24 urges the plunger button to the top position.

The volume dispensed per stroke of the plunger may be typically from 1 to 10 ml e.g. 2.5 or 5 ml.

The vertical outlet passage 52 communicates to the exterior of the body shell 2 via a stub mounting 26 and into a detachable or displaceable nozzle 8. This nozzle embodies the invention described in our WO2012/001375, the contents of which are hereby incorporated by reference and this is a preferred form, but not essential herein. Of relevance for the present proposals is that the nozzle 8 projects radially and upwardly relative to the general axis of the container and pump module. This means that in dosing, such as when dispensing a dose of medicine into a child's mouth, the container 100 is likely to be tilted with the rear side, the side remote from the nozzle, relatively upward.

Figure 4:
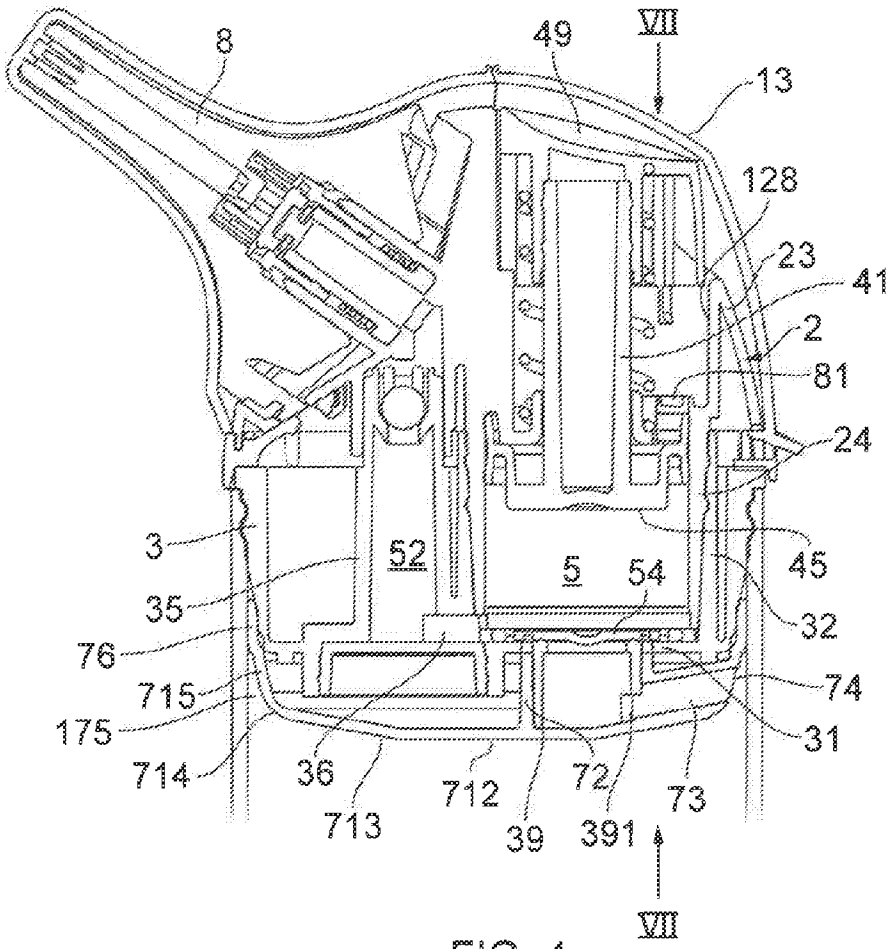
FIGS. 3 and 4 are corresponding sections (this time without perspective) of a slightly modified embodiment having the same pump module base structure and additionally a click indicator.
Figure 3:
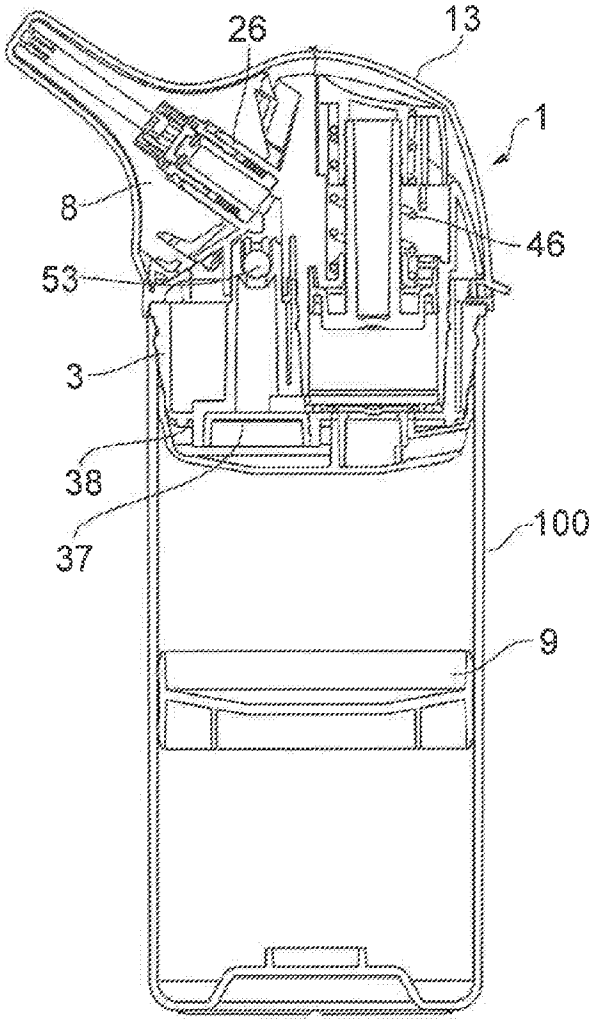

FIGS. 3 and 4 show an overcap 13 which covers both the nozzle and push button 49 and is or may be as disclosed in our GB1200258.0 filed 4 Jan. 2012 entitled "DISPENSERS", the contents of which are incorporated here by reference and to which reference may usefully be made, but its teachings are not essential to the present proposals.

FIGS. 1 to 4 show a characteristic novel structure of the base of the pump module, achieved in this embodiment by a base attachment 7 which fastens to the underside of the pump module beneath the above-mentioned floor 38 of the adaptor or mounting portion thereof. Specifically, beneath the circular inlet opening 31 in the floor (above which the discrete sprung flap valve unit 54 is mounted by trapping) an integral tubular projection 39 extends down. The base attachment 7 is a circular generally dish-shaped component, moulded in one piece from conventional plastics material and being over most of its extent a closed surface. At the position beneath the inlet it is formed with an upward tubular projection or socket 72 which fits and secures onto the downward tube 39 of the pump module floor 38.

The base attachment shapes the undersurface of the pump module to implement the above-mentioned aspect of the invention. Specifically, it is deepest in the centre, where there is a flat region 712, then with a gently sloping middle-outer region 713 which is thereby conical, but at less than 10° to the horizontal, and through a more sharply angled corner portion 714 to a steeply-inclined outer wall 715 and terminating in a sealing annulus 76 which is the outer diameter of the component. The bottom corner of the pump body adaptor fits closely into this sealing annulus 76, while the outside of the sealing annulus fits closely around against the surrounding wall of the container 100. Optionally a snap engagement with the body adaptor 3 is used to hold it in place more securely.

At the back of the base attachment disc 7 a generally radial inlet conduit tube 73 is moulded in, with an external inlet opening 74 through the steeply inclined wall portion 715, i.e. facing onto the internal wall of a container 100. The inner end of this inlet conduit 73 registers with a gate opening 391 in the rear wall of the downward tube 39, defining a complete inlet passage from the inlet opening 74 through the generally horizontal inlet conduit portion 73 and up through the tube 39 having the inlet valve 54. The inlet conduit 73 is slightly inclined to conform to the incline of the main web 713 of the attachment disc 7 beneath; this is not in itself functional but avoids thick parts in the moulded component.

In assembly of the dispenser, in the known fashion the container is prefilled to a desired level near the top. Preferably the follower plate 9 is slightly spaced above the bottom of the container for this purpose (in itself a known measure) and (also known) there is a small hole through the container base (not shown) allowing air flow so that the movement of the sealed follower plate 9 is not unduly inhibited.

As the pump module (with the base attachment 7 in place) is lowered into position, its shaped undersurface dips into the product. Initially, in the known manner (as in EP1629900) air is preferentially displaced out around the edge of the pump module, in particular because the entire undersurface is downwardly convex so that air is displaced out towards the edge and not trapped in the middle. Unlike EP1629900 however there is no inlet opening in the middle of the pump body base. The sealing annulus 76 of the base attachment 7 then makes a close fit into the container neck and escape of air by that route stops. As movement of the pump module continues to its eventual snap (secured) position, there is a combination of some flow into the pump chamber through the pump inlet structures, (provided that the pump nozzle or nozzle stub is sufficiently open) and some downward movement of the follower plate 9 onto its stop on the base of the container. These two movements are balanced by the level of filling, the speed of fitting the head and by the size of the hole in the container base preventing over-rapid descent of the follower plate 9.

Between the outwardly-directed steeply-inclined surface (inclined at greater than 60°) of the base attachment 7 and the inwardly-directed surface of the container is an annular, steeply upwardly-convergent space which terminates at the sealing annulus 76. This space constitutes an air pocket 175 where any residual air collects initially and, if there is subsequent rising of bubbles, subsequent to filling and assembly. The inlet opening 74 of the pump module base attachment 7 opens into this air pocket region. In the embodiment of FIGS. 1 to 4 it opens into the rear of the air pocket region.

When the dispenser is used, the rear comes to the top and collected air accumulates predominantly at the entrance i.e. at the inlet opening 74. So, it will be taken up into any initial priming movements of the pump (because any dispenser pump usually needs one or two strokes to prime it for the first dose in any case). This purges or scavenges the air so that accurate dosing is achieved subsequently.

Figure 6:
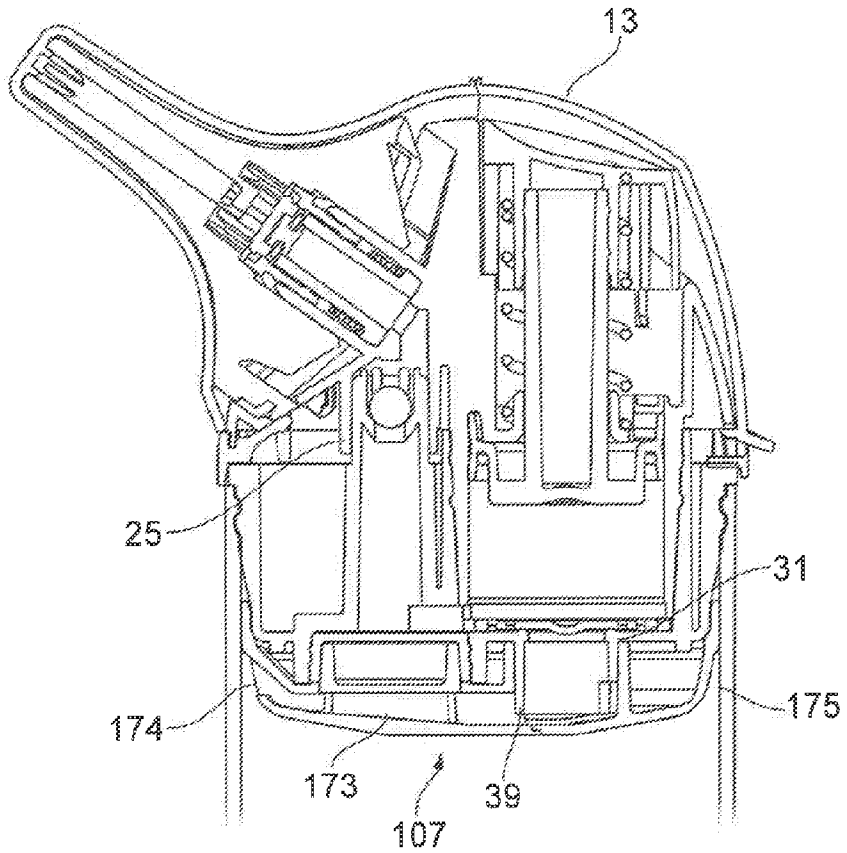
FIGS. 5 and 6 are corresponding cross-sectional drawings of a second embodiment having the same click indicator and a different structure of the pump module base.
Figure 5:
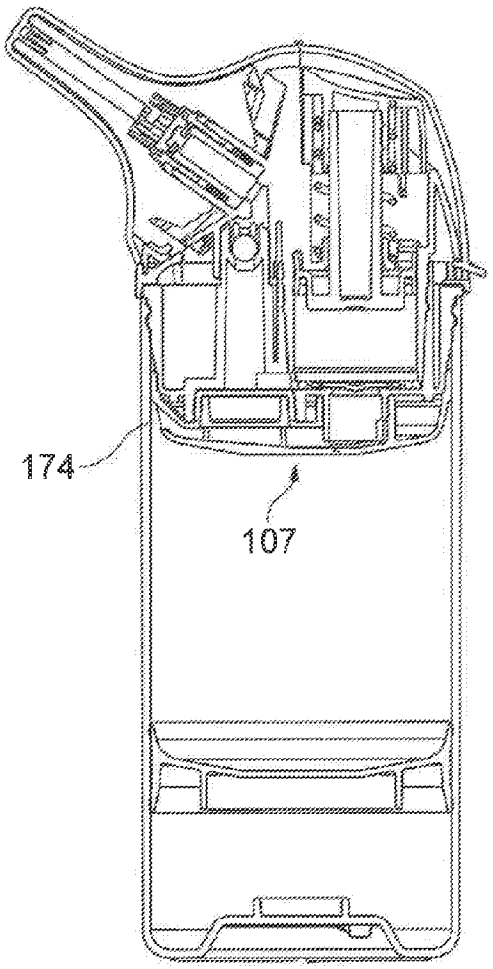

FIGS. 5 and 6 show an alternative version. Here the base attachment 107 has the inlet opening instead at the front, and defines a rather longer generally horizontal inlet conduit 173 extending rearward to the pump chamber inlet 31 and its downward tube 39 which are the same as before. Indeed, the version shown has an identical tubular formation 39 but of course it is possible to modify the tubular formation 39 below the inlet opening to enlarge the flow area from the inlet conduit 173 to the front chamber inlet 31.

Thus, the inlet opening 174 is directly beneath the nozzle of the dispenser. The idea here is that, recognising that any trapped air in the air pocket zone 175 would tend to be at the rear of the dispenser in use, positioning the inlet opening 174 at the front reduces the chance that any such air will get into dispensed doses. During assembly of the dispenser, however, it enables purging or scavenging of air in just the same manner as in the embodiment of FIGS. 3 and 4.

Figure 8:
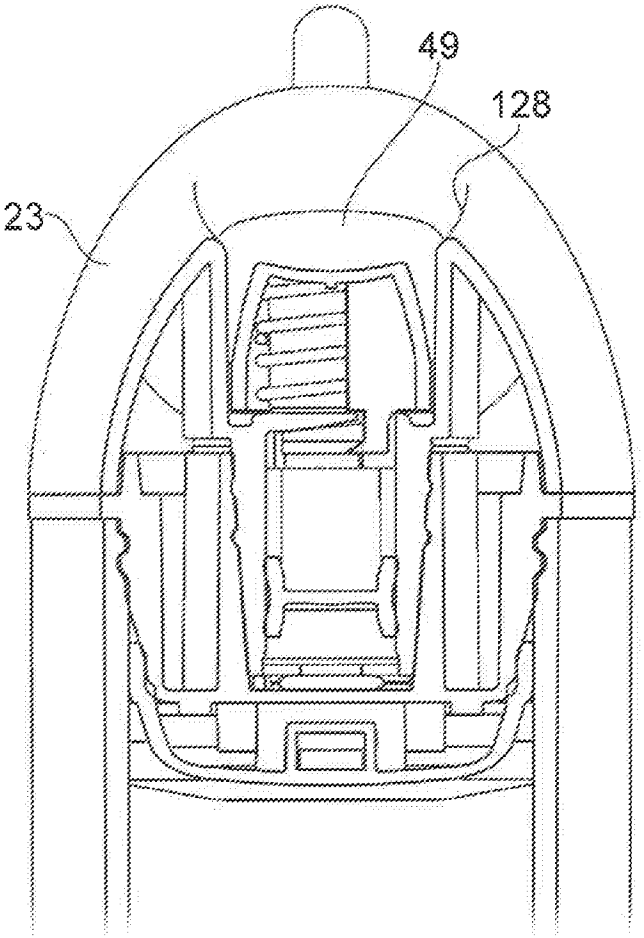
FIGS. 7 and 8 are sectional views (sectioned at VII-VII seen in FIG. 4) of the modified first embodiment showing the click indicator structures in operation, in the fully raised and fully depressed positions of the plunger.
Figure 7:
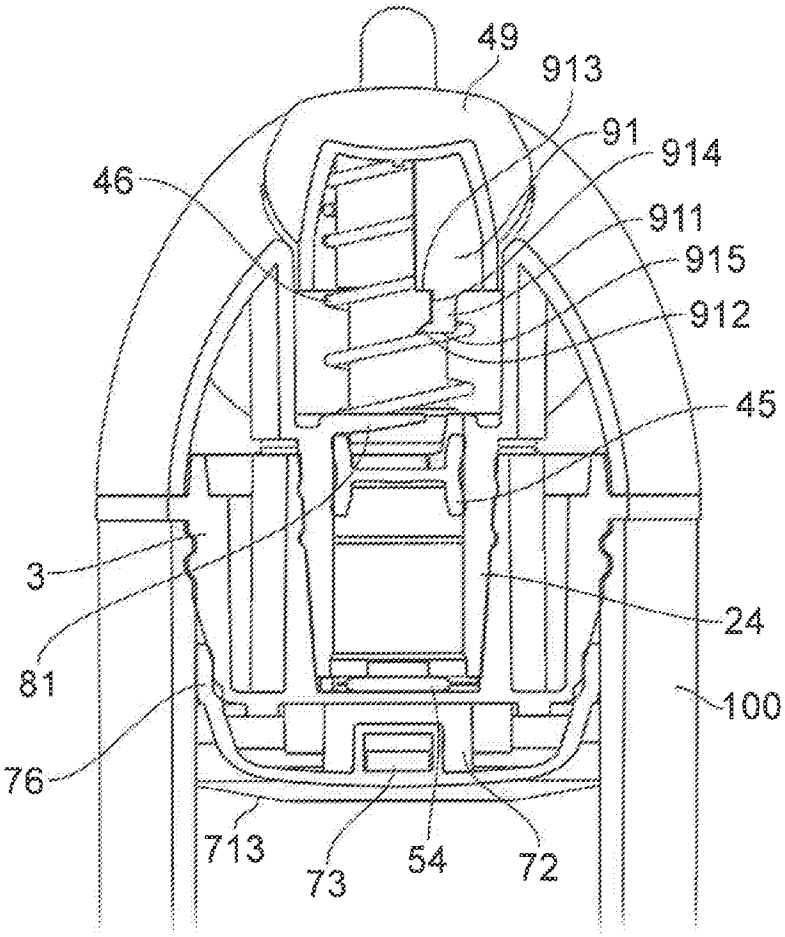

The modification shown in the embodiments of FIGS. 3, 4 and 7, 8 enables an audible "click" signal when the stroke has been completed. [The section in FIGS. 7, 8 is towards the rear of the cylinder 24, hence the apparent change in width.] Around the rear top edge of the cylinder formation 24, i.e. as an integral part of the upper body component 2, a click finger 81 extends. It is formed as a cantilever extending generally horizontally around the circumference of the top of the cylinder so that it has substantial free length and is able to flex. However it occupies no additional space, and is protected by the surround or recess 128 of the body shell. The corresponding click actuator formation 91 is formed as a dependent integral structure on the underside of the plunger cap 49. It takes generally the form of a sideways (circumferentially-facing) hook with its point directed around the circumference and aligned above the point of the click projection in the plunger-up position: FIG. 7.

Dissecting the functions of the hook: its bottom flat surface 915 constitutes a pusher which, when the plunger approaches within a predetermined distance of the bottom of its stroke, meets the tip of the click finger 81 and starts to bend it downwards. The point 912 of the hook gives a well-defined escape point so that when the finger has bent far enough to retract circumferentially out of engagement, it flicks up past the point 912 immediately under its own resilience. The recess or cutaway portion 914 above the point provides space for the fast-moving tip. The downwardly directed surface 913 above the clearance constitutes a stop surface which the tip of the finger 81 hits sharply, at the position seen in FIG. 8, giving a clear click signal.

The flexible tip formation is long and therefore only lightly strained in operation, so as to maintain a good click lifetime, without increasing the component count in the device, using an existing injection-moulded part.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A pump dispenser comprising a container and a pump module, the container being adapted to contain a fluid product and defining a top opening, said pump module being fitted into said top opening, and comprising:

a pump body;

a pump plunger;

an adaptor portion;

whereby the pump body is mounted into the container, the pump body and pump plunger defining a pump chamber between them and the pump plunger being reciprocable relative to the pump body in a pumping stroke to alter the volume of the pump chamber;

wherein the pump module having a downwardly-directed base structure that includes a downwardly-directed central displacement base portion and a peripheral air pocket region which is adjacent a container wall in the assembled dispenser; and wherein a pump inlet opening which is defined by the inlet structure of the pump module leading to the pump chamber thereof, opens into the air pocket region, whereby trapped air accumulating in the air pocket region tends to be forced or drawn out of the container space and into the pump, either during assembly or on initial priming of the pump in use, before product is dispensed.

2. The pump dispenser according to claim 1 wherein the central displacement base portion is flat or downwardly convex.

3. The pump dispenser according to claim 2 wherein the air pocket region is defined between the container wall and an inclined surface of the central displacement base portion which, in an upper region, converges with the container wall.

4. The pump dispenser according to claim 3 which has a laterally-directed dispensing nozzle, and the air pocket region is present at least at the position opposite the nozzle.

5. The pump dispenser according to claim 4 wherein the downwardly-directed pump module base structure is provided as a discrete element attached beneath an internal floor of the pump module.

6. The pump dispenser according to claim 5 wherein the pump plunger has an outer part which is outside the pump chamber, and one of the body and plunger carries a click projection and the other has a click actuating formation which meets a tip of the click projection as the plunger approaches the bottom of its stroke, the click projection being elongate and resiliently flexible, the arrangement being such that the click actuating formation bends the click projection against its resilience as the plunger approaches the completion of its stroke, and, at the stroke endpoint, the click projection escapes the actuating portion, so that the click projection is suddenly released and resiliently returned to its original orientation.

7. The pump dispenser according to claim 6 wherein the click actuating formation has a counter-surface which is struck by the tip of the click projection to emit a click signal.

8. The pump dispenser according to claim 1 wherein the air pocket region is defined between the container wall and an inclined surface of the central displacement base portion which, in an upper region, converges with the container wall.

9. The pump dispenser according to claim 1 which has a laterally-directed dispensing nozzle, and the air pocket region is present at least at the position opposite the nozzle.

10. The pump dispenser according to claim 1 wherein the downwardly-directed pump module base structure is provided as a discrete element attached beneath an internal floor of the pump module.

11. The pump dispenser according to claim 1 wherein the pump plunger has an outer part which is outside the pump chamber, and one of the body and plunger carries a click projection and the other has a click actuating formation which meets a tip of the click projection as the plunger approaches the bottom of its stroke, the click projection being elongate and resiliently flexible, the arrangement being such that the click actuating formation bends the click projection against its resilience as the plunger approaches the completion of its stroke, and, at the stroke endpoint, the click projection escapes the actuating portion, so that the click projection is suddenly released and resiliently returned to its original orientation.

12. A pump dispenser comprising a container and a pump module, the container being adapted to contain a fluid product and defining a top opening, said pump module being fitted into said top opening, and comprising:

a pump body;

a pump plunger;

an adaptor portion;

whereby the pump body is mounted into the container, the pump body and pump plunger defining a pump chamber and the pump plunger being movable relative to the pump body to alter the volume of the pump chamber;

wherein the pump module having a base structure that includes a displacement base portion and a peripheral air pocket region which is adjacent a container wall in the assembled dispenser; and wherein a pump inlet opening which is defined by the inlet structure of the pump module leading to the pump chamber thereof, opens into the air pocket region, whereby trapped air in the air pocket region exits the container space and flows into the pump, either during assembly or on initial priming of the pump in use, before product is dispensed.

13. The pump dispenser according to claim 12 wherein said pump plunger movement is reciprocable.

14. The pump dispenser according to claim 12 wherein said base structure is downwardly directed.

15. The pump dispenser according to claim 12 wherein said displacement base portion is downwardly directed.

* * * * *